United States Patent [19]

Gilman et al.

[11] Patent Number: 4,758,273

[45] Date of Patent: Jul. 19, 1988

[54] DISPERSION STRENGTHENED ALUMINUM ALLOYS

[75] Inventors: Paul S. Gilman, Suffern; Stephen J. Donachie, New Windsor, both of N.Y.; Robert D. Schelleng, Barboursville, W. Va.

[73] Assignee: INCO Alloys International, Inc., Huntington, W. Va.

[21] Appl. No.: 898,579

[22] Filed: Aug. 21, 1986

Related U.S. Application Data

[63] Continuation-in-part of Ser. No. 664,058, Oct. 23, 1984, and a continuation-in-part of Ser. No. 664,241, Oct. 24, 1984.

[51] Int. Cl.[4] ..... C22C 21/02; C22C 21/04

[52] U.S. Cl. ..... 75/249; 75/234; 75/237; 419/32

[58] Field of Search ..... 75/232, 234, 235, 236, 75/237, 249; 420/546, 547; 419/30, 32, 38, 41, 60, 67

[56] References Cited

U.S. PATENT DOCUMENTS

| | | | |
|---|---|---|---|
| 3,226,267 | 12/1965 | Foerster | 419/41 |
| 3,343,948 | 9/1967 | Raclot | 420/549 |
| 3,740,210 | 6/1973 | Bomford et al. | 75/0.5 BC |
| 3,816,080 | 6/1974 | Bomford et al. | 75/233 |
| 4,292,079 | 9/1981 | Pickens et al. | 75/232 |
| 4,297,136 | 10/1981 | Pickens et al. | 75/234 |
| 4,409,038 | 10/1983 | Weber | 148/415 |
| 4,435,213 | 3/1984 | Hildeman et al. | 75/249 |
| 4,532,106 | 7/1985 | Pickens | 75/233 |
| 4,557,893 | 12/1985 | Jatkar et al. | 419/13 |
| 4,597,792 | 7/1986 | Webster | 75/249 |
| 4,600,556 | 7/1986 | Donachie et al. | 420/542 |
| 4,643,780 | 2/1987 | Gilman et al. | 148/12.7 A |
| 4,661,172 | 4/1987 | Skinner et al. | 75/249 |

FOREIGN PATENT DOCUMENTS

| | | | |
|---|---|---|---|
| 1178218 | 9/1964 | Fed. Rep. of Germany | 420/549 |
| 55-21518 | 2/1980 | Japan | 419/41 |

*Primary Examiner*—John F. Terapane
*Assistant Examiner*—Eric Jorgensen
*Attorney, Agent, or Firm*—Raymond J. Kenny; Francis J. Mulligan

[57] ABSTRACT

A process for decreasing the embrittling tendency of lithium in aluminum-base alloy compositions containing lithium comprising incorporating silicon in the alloy composition and forming the alloy as a dispersion strengthened powder, and dispersion strengthened aluminum-base alloy compositions comprised of aluminum, lithium and silicon having improved properties.

17 Claims, 1 Drawing Sheet

DISPERSION STRENGTHENED ALUMINUM ALLOYS

This is a continuation-in-part of copending application Ser. No. 664,058 filed on Oct. 23, 1984 and Ser. No. 664,241 filed on Oct. 24, 1984.

TECHNICAL FIELD

The present invention relates to a dispersion strengthened alloy system comprising aluminum, lithium and silicon and to a method of producing forged "mechanically alloyed" aluminum alloys of such system having improved mechanical properties.

BACKGROUND OF THE INVENTION

In recent years there has been an intensive search for high strength aluminum which would satisfy the demands of advanced design in aircraft, automotive, naval and electrical industries. While high strength is a key characteristic of the materials sought, to meet the qualifications for certain advanced design applications the alloys must meet a combination of property requirements such as density, strength, ductility, toughness, fatigue and corrosion resistance, depending on the ultimate end use of the materials. The complexity of the problem goes far beyond the difficulties of developing materials with suitable combinations of properties not achieved before. Economics also plays a large role in the choice of materials. The ultimate product forms are often complex shapes, and the potential savings resulting from possible composition substitution is only a part of the picture. The new aluminum alloys would be particularly valuable if they could be shaped into desired forms using cost effective techniques such as forging while maintaining good characteristics and/or if they could be fabricated economically into the same complex shapes now used with other materials so as to eliminate the need for retooling for fabrication of weight saving structures.

The use of powder metallurgy routes to produce high strength aluminum has been proposed and has been the subject of considerable research. Powder metallurgy techniques generally offer a way to produce homogenous materials, to control chemical composition and to incorporate dispersion strengthening particles into the alloy. Also, difficult-to-handle alloying elements can at times be more easily introduced by powder metallurgy than ingot melt techniques. The preparation of dispersion strengthened powders having improved properties by a powder metallurgy technique known as mechanical alloying has been disclosed, e.g., in U.S. Pat. No. 3,591,362 (incorporated herein by reference). Mechanically alloyed materials are characterized by fine grain structure which is stabilized by uniformly distributed dispersoid particles such as oxides and/or carbides. U.S. Pat. Nos. 3,740,210, 3,816,080 (incorporated herein by reference) pertain particularly to the preparation of mechanically alloyed dispersion strengthened aluminum. Other aspects of mechanically alloyed aluminum-base alloys have been disclosed in U.S. Pat. Nos. 4,292,079, 4,297,136, 4,409,038, 4,532,106, 4,557,893 and 4,600,556.

For most uses a powder must be fabricated into a final product, e.g, by degassing, compaction, consolidation and shaping in one or more steps. To obtain complex parts the fabrication may take the form, e.g., of extruding, forging and machining. Usually, the less machining required to make a part the greater the economy in material use, labor and time. It will be appreciated that it is an advantage to be able to make a complex shape by forging rather than by a route which requires the shaping by manual labor on an individual basis.

It is academic that composition of an alloy often dictates the fabrication techniques that can be used to manufacture a particular product. In general, the target properties which must be attained in the type aluminum alloys of this invention before other properties will be considered are strength, density and ductility. One of the marked advantages of mechanically alloyed powders is that they can be made into materials having the same strength as materials made of similar compositions made by other routes, but with a lower level of dispersoid. This enables the production of alloys which can be fabricated more easily without resorting to age hardening additives. While the mechanical alloying route produces materials that are easier to fabricate than other aluminum alloys of comparable composition, the demands for strength and low density and the additives used to obtain higher strength and/or lower density usually decrease workability of the alloy system. (Workability takes into account at least ductility at the working temperature and the load necessary to form the material). The extent of the effect is generally related to the level of additive in the alloy. The additives not only affect the method by which the material can be fabricated, but also the fabrication techniques affect the properties of the materials.

In designing low density aluminum alloys, preferred additives are magnesium and lithium. These elements not only lower the density but also increase the strength of the aluminum. Lithium also increases the elastic modulus of aluminum. These highly useful effects are the basis for current interest in developing alloys of this type. However, efforts to develop high strength alloys of this type have been severely hampered by the propensity for these alloys to display relatively low tensile strength and low fracture toughness.

U.S. patent application Ser. No. 664,058, co-pending herewith discloses Al-Mg-Li alloys which are strengthened through mechanical alloying and then prepared in the forged condition. These alloys have useful properties and the processing route disclosed enables the possibility of using a wider range of conditions under which the materials can be forged and affords improved reproducibility of the forged parts. While the alloys disclosed have highly desirable properties, they have limitations. For example, lithium additions are far more effective in lowering the density of aluminum than any other element. Each percent of lithium added reduces density by about 3%. The maximum solubility of lithium in aluminum is about 4% at elevated temperatures, but drops to about 1.3% (wt. %) at room temperature. (Sanders & Starke, Aluminum-Lithium Alloys, AIME Proceedings, May 19–21, 1980.) In view of the benefits of lithium addition, it is desirable to add as much lithium as possible. However, if lithium is increased above the solubility limit the alloys become age hardenable and susceptible to embrittlement in service. In the alloy system of the present invention, which incorporates silicon in Al-Mg-Li system, the silicon decreases the likelihood of damaging embrittlement. Thus, it is possible to gain the advantages of incorporating higher amounts of lithium while decreasing the embrittling effect, thereby obtaining alloys of decreased density and good ductility.

BRIEF DESCRIPTION OF DRAWING

FIGS. 1A and 1B show numbered sections corresponding to the areas used for test samples.

SUMMARY OF THE INVENTION

Figure 1A:
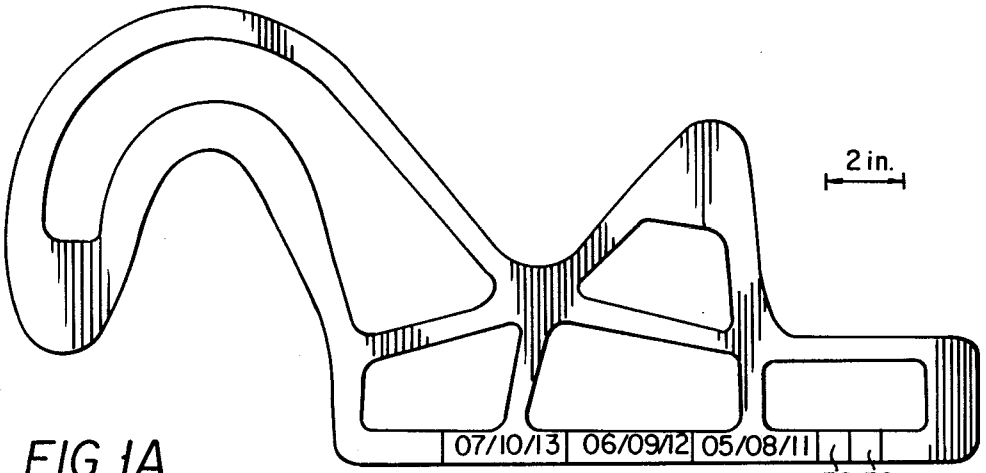
FIG. 1A is a plan drawing of a "Hook"-type forging.
Figure 1B:
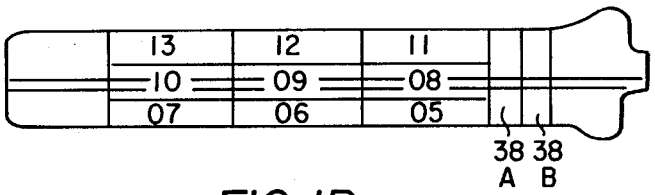
FIG. 1B is a view of the flange of FIG. 1A.

The present invention is directed to a process for decreasing the embrittling tendency of lithium in aluminum-base alloy compositions containing lithium, comprising incorporating silicon in the alloy composition and forming the alloy as a dispersion strengthened alloy powder and to dispersion strengthened aluminum-base compositions comprised of aluminum, lithium and silicon. The dispersion strengthened alloy powder can be formed, for example, by mechanical alloying, by addition of dispersion forming elements in atomized powders or a combination thereof.

In a preferred embodiment of the present invention the alloy system is a dispersion strengthened, low density aluminum-base alloy comprised of aluminum, lithium, magnesium and silicon. Advantageously the alloy is prepared in the forged condition.

Alloys of the present invention the dispersion strengthened alloy system consist essentially of, by weight: lithium, an amount which is above the solubility limit at room temperature for a given alloy system up to the maximum solubility of lithium in aluminum at elevated temperature. For example, in the Al-Li system per se the lithium content ranges from about 1.3% up to the maximum amount permitted by the particular powder forming technique, e.g., with mechanical alloying about 4%. For an Al-Li-Mg system the lithium range is also about 1.5% up to about 4%. A typical lithium range for alloy systems of the present invention is about 0.5% up to about 4%, silicon, a small but effective amount for improved ductility or strength up to about 4%; magnesium, 0 up to about 7%. In alloys containing magnesium the magnesium level is a small but effective amount for increased strength up to about 7%; carbon, a small but effective amount for increased strength up to about 5%, oxygen, a small but effective amount for increased strength and stability up to about 1%; and the balance essentially aluminum, and the dispersoid content attributable to carbides and oxides ranges from a small but effective amount for increased strength up to about 25% by volume, advantageously less than about 10 vol. % and preferably less than about 8 vol. %.

In a preferred embodiment of the present invention a forged article composed of an alloy of this invention is prepared from a mechanically alloyed powder by a sequence of steps comprising: degassing and compacting said powder to obtain a compacted body of about substantially full density, e.g., by vacuum hot pressing, extrusion and forging.

In an advantageous embodiment of the present process the alloy system contains about 1.3% up to about 3% lithium, about 1% up to about 4.5% magnesium, about 0.5% up to about 2% silicon, about 0.5% to about 2% carbon and about 0.02% up to less than about 1% oxygen.

In one aspect of the invention the Al-Li alloys have a density of less than about 2.8 g/cc, e.g. about 2.3 to about 2.6 g/cc.

DETAILED ASPECTS OF THE INVENTION (A) Composition

The essential components of the matrix of the alloy systems of the present invention are aluminum, lithium and silicon. In a preferred composition magnesium is also required. The alloys are characterized in that they are dispersion strengthened and they are formed as a powder, e.g., by mechanical alloying, by addition of dispersion forming elements in atomized powders or a combination thereof. In one preferred embodiment the products are prepared as forged articles. The dispersion strengthening agents comprise carbides, oxides, silicides, and possibly other intermetallic compounds.

Compounds of carbon, oxygen and silicon are present as a small weight percentage of the alloy system as insoluble dispersoids such as oxides and/or carbides and/or silicides. Other elements may be incorporated in the alloy so long as they do not interfere with the desired properties of the alloy for a particular end use. Also, a minor amount of impurities may be picked up from the charge materials or in preparing the alloy. Additional insoluble, stable dispersoids or dispersoid forming agents may be incorporated in the system, e.g., for strengthening of the alloy at elevated temperatures, so long as they do not otherwise adversely affect the alloy.

Unless otherwise specified, concentration of components is given in weight %.

As indicated above, the lithium level in the alloys will depend on the particular Al-Li alloy of choice and can range from an amount which is above the solubility limit of lithium in such alloy at room temperature up to the maximum solubility of lithium in the alloy at elevated temperatures. Typically the lithium range is from about 0.5 to about 4%, advantageously in an amount of about 1 up to about 3%, and preferably from about 1.5 or 1.6 up to about 2.5%. The lithium is introduced into the alloy system as a powder (elemental or preferably prealloyed with aluminum) thereby avoiding problems which accompany the melting of lithium in ingot metallurgy methods.

The silicon level ranges, for example, from a small but effective amount for strength up to about 4%. Advantageously the alloys contain about 0.2 up to about 2%, and preferably about 0.5% to about 1.5%, and typically about 0.5 to about 1%.

In magnesium containing alloys, the magnesium level ranges from a small but effective amount for increased strength, e.g., about 0.5% to about 7%. Advantageously, the magnesium level may range from above 1 up to above about 4%, e.g. up to about 5%, preferably it is about 2 up to about 4 or 4.5%. Exemplary alloys in the Al-Li-Mg-Si system contain above 1.5 up to about 2.5% lithium and about 2 to about 4.5% magnesium.

Carbon is present in the system at a level ranging from a small but effective amount for increased strength up to about 5%. Typically the level of carbon ranges from about 0.05 up to about 2%, advantageously from about 0.2% up to about 1% or 1.5%, preferably about 0.5 up to about 1.2%. The carbon is generally provided by a process control agent during the formation of the mechanically alloyed powders. Preferred process control agents are methanol, stearic acid, and graphite. In general the carbon present will form carbides, e.g. with one or more of the components of the system.

Oxygen is usually present in the system, and it is usually desirable at a very low level. In general, oxygen is present in a small but effective amount for increased strength and stability, e.g. about 0.05%, up to 1%, and preferably, it does not exceed about 0.4 or 0.5%. As disclosed in a previous U.S. patent application, the low oxygen content is believed to be critical. When the oxygen content is above 1% the alloy is found to have poor ductility. In alloys containing above 1.5% Li, the oxygen content preferably does not exceed about 0.5%.

Because of the effect of silicon in permitting greater amounts of lithium addition than previously believed possible—without sacrificing ductility—this surprising effect opens the door to the possibility of strengthening the alloy system by addition of heavier elements such as copper, cobalt, zinc manganese, nickel, iron, chromium, titanium, niobium, zirconium, vanadium, rare earth metals (e.g. cerium and/or the addition of greater amounts of magnesium. It will be appreciated that the alloys may contain other elements which when present may enhance certain properties and in the amounts in which they are present do not adversely affect the alloy of a particular end use.

The dispersoid content of the alloy comprises oxides, carbides and silicides. The dispersoid content attributable to carbides and oxides is in a range of a small but effective amount for increased strength up to about 25 volume % (vol. %) calculated on the basis of carbides as $Al_4C_3$ and oxides as $Al_2O_3$, advantageously less than about 10 vol. %, and preferably less than about 8 vol. %. Preferably the dispersoid level is as low as possible consistent with desired strength. Typically the dispersoid level is about 1.5 to 7 vol. %. Preferably it is about 2 to 6 vol. %. Other dispersoids may be present, for example, compounds or intermetallics of aluminum, lithium, silicon or magnesium or combinations thereof. Carbide and silicide dispersoids can be formed during the mechanical alloying step and/or later during consolidation or thermomechanical processing and/or they may be added as such to the powder charge. Other dispersoids may be added or formed in-situ. Beneficial dispersoids from the standpoint of strength and stability of the alloy system are stable in the aluminum alloy matrix at the ultimate temperature of service. Examples of oxide and carbide dispersoids that may be present are $Al_2O_3$, AlOOH, $Li_2Al_2O_4$, $LiAlO_2$, $LiAl_5O_8$, $Li_5AlO_4$, $Al_4C_3$. Other dispersoids may also be present depending on the alloy system, e.g., $Al_2MgLi$, MgO, $Mg_2Si$, $Al_2MgLi$, $Al_2Cu$, $Al_2CuLi$.

In a preferred alloy system the lithium content is about 1.5 up to about 2.5%, the magnesium content is about 2 up to about 4.5%, the carbon content is about 0.5 to about 2%, the oxygen content is less than about 0.5%, and the dispersoid level attributable to carbides and oxides is about 2 or 3 to 10 volume %. For example, the Al-Mg-Li-Si alloys may be comprised of: Al-2Mg-2.5Li-1.0Si-0.7C, Al-4Mg-1.5Li-0.5Si-1.1C, Al-2Mg-1.5Li-0.5Si-1.1C, Al-2Mg-2Li-0.5Si-1.1C, Al-2Mg-1.5Li-1Si-1.1C, Al-2Mg-2Li-1Si-1.1C, Al-2Mg-1.75Li-1Si-0.7C, Al-4Mg-1.5Li-1Si-0.7C, Al-4Mg-1.5Li-0.5Si-2C, Al-4Mg-1.5Li-1Si-1.1C, Al-4Mg-2Li-1Si-1.1C.

(B) Alloy Preparation Prior to Fabrication of End Use Product

As indicated above the alloy is prepared as a dispersion strengthened powder, but is not limited in how the powder is prepared. Preferable routes are by mechanical alloying and/or atomization technique. The description below is given mainly with reference to formation of the powder by a mechanical alloying route.

(1) Mechanical Alloying to Form Powders

The mechanical alloying technique is a solid-state milling process, which is described in the aforementioned patents incorporated herein by reference. Briefly, aluminum powder is prepared by subjecting a powder charge to dry, milling in the presence of a grinding media, e.g. balls, and a process control agent, under conditions sufficient to comminute the powder particles to the charge, and through a combination of comminution and welding actions caused repeatedly by the milling, to create new, dense composite particles containing fragments to the initial powder materials intimately associated and uniformly interdispersed. Milling is done in a protective atmosphere, e.g. under an argon blanket, thereby facilitating oxygen control since when carried out in this way virtually the only sources of oxygen are the starting powders and the process control agent. However, controlled amounts of oxygen can be admitted into the mill as a further source of oxygen if desired. The process control agent is a weld-controlling amount of a carbon-contributing agent and may be, for example, graphite or a volatilizable oxygen-containing hydrocarbon such as organic acids, alcohols, aldehydes and ethers. The formation of dispersion strengthened mechanically alloyed aluminum is given in detail in U.S. Pat. Nos. 3,740,210 and 3,816,080, mentioned above. Suitably the powder is prepared in an attritor using a ball-to-powder weight ratio of 15:1 to 60:1. As indicated above, preferably process control agents are methanol, stearic acid, and graphite. Carbon from these organic compounds and/or graphite is incorporated in the powder and contributes to the dispersoid content.

(2) Degassing and Compaction

Before the dispersion strengthened mechanically alloyed powder is fabricated it must be degassed and compacted. Degassing and compacting are effected under vacuum and generally carried out at a temperature in the range of about 480° C. (895° F.) up to just below incipient liquefication of the alloy. The degassing temperature should be higher than any subsequently experienced by the alloy. Degassing is preferably carried out, for example, at a temperature in the range of from about 480° C. (900° F.) up to 545° C. (1015° F.) and more preferably above 500° C. (930° F.). Pressing is carried out at a temperature in the range of about 545° C. (1015° F.) to about 480° C. (895° F.).

In a preferred embodiment the degassing and compaction are carried out by vacuum hot pressing (VHP). However, other techniques may be used. For example, the degassed powder may be upset under vacuum in an extrusion press. To enable the powder to be extruded to substantially full density, compaction should be such that the porosity is isolated, thereby avoiding internal contamination of the billet by the extrusion lubricant. This is achieved by carrying out compaction to at least 85% of full density, advantageously above 95% density, and preferably the material is compacted to over 99% of full density. Preferably the powders are compacted to 99% of full density and higher, that is, to substantially full density.

The resultant compaction products formed in the degassing and compaction step or steps are then fabricated in forms appropriate for use.

(C) Fabrication

Fabrication of the alloy into useful products comprises both consolidation and shaping. Consolidation and shaping to final form may be carried out by conventional fabrication methods, e.g., rolling, swaging, extruding, forging, and combinations thereof, and it will be understood that preparation of the alloy is not limited to any one method of production. However, the present alloys are described below mainly with reference to forging. As explained previously for certain purposes forging has advantages.

(1) Consolidation

The purpose of consolidation in the fabrication steps is to insure full density in the alloy. Both achieving full density and breakup of any surface oxide can on the particles be obtained, for example, by extrusion.

If the alloys are prepared in the forged condition, as explained in the aforementioned U.S. application Ser. No. 664,058, the extrusion temperature is advantageously held within a narrow range and the lubrication practice and the conical die-type equipment used for the extrusion are important. For example, in a forged embodiment of the present invention, the extrusion temperature is in the range of above the incipient extrusion temperature up to about 400° C. (750° F.) said extrusion being carried out with lubrication, preferably through a conical die to provide an extruded billet of substantially full density is chosen so that the maximum temperature achieved in the extruder is no greater than 28° C. (50° F.) below the solidus temperature. Typically in the Al-Li-Mg-Si alloy system, it will be in the range of about 230° C. (450° F.) and about 400° C. (750° F.). Advantageously, it should be carried out below about 370° C. (700° F.), preferably in the range of about 260° C. (500° F.) to about 300° C. (675° F.), and more preferably should not exceed about 345° C. (650° F.) or even should be lower than about 330° C. (625° F.). The temperature should be high enough so that the alloy can be pushed through the die at a reasonable pressure. Typically this will be above about 230° C. (450° F.). It has been found that a temperature of about 260° C. (500° F.) for extrusion is highly advantageous. By carrying out the extrusion at about 260° C. (500° F.), there is the added advantage of greater flexibility in conditions which may be used during the forging operation. This flexibility decreases at the higher end of the extrusion temperature range.

By incipient extrusion temperature is meant the lowest temperature at which a given alloy can be extruded on a given extrusion press at a given extrusion ratio. The extrusion ratio is at least 3:1 and may range, for example, to about 20:1 and higher.

The above given extrusion temperature ranges used for the Al-Li-Si are those which will maximize the strength of the alloy since strength is currently the initial screening test for the forged parts made from the aluminum-base alloys. It will be appreciated that when the strength requirements are not as rigorous the teachings of this invention can be used to trade-off strength against some other property.

The extrusion in the present process is preferably carried out in a conical-faced die as opposed to a shear-faced die. By a conical die is meant a die in which the transition from the extrusion liner to the extrusion die is gradual. Advantageously the angle of the head of the die with the liner is less than about 60°, and preferably it is about 45°.

Lubrication is applied to the die or the compaction billet or both of them. The lubricants, which aid in the extrusion operation, must be compatible with the alloy compaction billet and the extrusion press, e.g. the liner and die. The lubricant applied to the billet further protects the billet from the lubricant applied to the extrusion press.

Properly formulated lubricants for specific metals are well known in the art. Such lubricants take into account, for example, requirements to prevent corrosion and to make duration of contact of the billet with the extrusion press less critical. Examples of lubricants for the billets are kerosene, mineral oil, fat emulsion and mineral oil containing sulfurized fatty oils. Fillers such as chalk, sulfur and graphite may be added. An example of a lubricant for an extrusion press is colloidal graphite carried in oil or water, molybdenum disulfide, boron sulfide, and boron nitride.

The extruded billets are then in condition to be forged. If necessary the billets may be machined to remove surface imperfections.

(2) Forging

In general forged aluminum alloys of the present invention will benefit from forging temperatures being as low as possible consistent with the alloy composition and equipment. Forging may be carried out as a single or multi-step operation. In multi-step forging the temperature control applies to the initial forging or blocking-type step. As in the extrusion step, it is believed that for high strength the aluminum alloys of this invention should be forged at a temperature below one where a decrease in strength will occur. Forging should be carried out below about 400° C. (750° F.), and preferably less than 370° C. (700° F.), e.g. in the range of 230° C. (450° F.) to about 345° C. (650° F.), typically about 260° C. (500° F.). Despite the fact that forgeability may increase with temperature, the higher forging temperatures have now been found to have an adverse effect on strength. In a multi-step forging operation it has been found that it is the initial step that is critical. In subsequent forging steps of a multi-step operation after the initial forging step the temperature range for forging may be above that recommended for this process. For maximizing strength forging is carried out at the lower end of the temperature range when the extrusion is carried out at the higher end of the extrusion range. For example, for this alloy system, the forging operation (or in a multi-step forging operation the initial forging step) is carried out at a temperature of about 230° C. (450° F.) to about 400° C. (750° F.) when extrusion is carried out at about 260° C., and the forging operation (or initial forging step) is carried out at a narrow range at the lower end of the extrusion temperature range, e.g. at about 260° C. (500° F.) when extrusion is previously carried out at 370° C. (700° F.).

As noted in the aforementioned U.S. application Ser. No. 664,058, while it is known in the art that conditions of forging aluminum alloys will vary with composition, it was surprising that the forging conditions—particularly the temperature—at which the alloys could be forged is related to the temperature at which the alloy is consolidated, and in particular extruded.

(3) Age Hardening

A heat treatment may be carried out, if desired, on alloy systems susceptible to age hardening. In alloys having age hardenable components additional strength may be gained, but this may be with the loss of other properties, e.g. corrosion resistance. As indicated above with addition of silicon age hardening due to lithium is decreased. This surprising effect of the addition of silicon has the beneficial effect of reducing embrittlement due to lithium so that the density of the alloy system can be reduced by lithium addition while maintaining good ductility. As a result greater amounts of lithium can be added with attendant advantages of production of lower density aluminum. As indicated above, to increase strength while maintaning satisfactory ductility other alloying elements may then be added. For example, greater amounts of magnesium may be added. Also, heavier elements such as Cu, Co, Zn, Mn, Ni, Fe, Cr, Ti, Nb, Zr, V and/or rare earth elements can be added and the alloy may still be in permissible density range. It is a particular advantage of the present invention that low density aluminum alloys can be made with high strength, e.g., an 0.2% offset YS of over 410 MPa (60 ksi) and an elongation greater than 3, in the forged condition without having to resort to precipitation hardening treatments which might result in alloys which have less attractive properties other than strength.

It is noted that in the discussion above and in the Examples, in conversion from °F. to °C., the temperatures are rounded off, as are the conversion from ksi to MPa and inches to centimeters. Also alloy compositions are nominal and are given in weight % unless otherwise noted, e.g., for dispersoid content. With respect to conditions for commercial production, it is not practical or realistic to impose or require conditions to the extent possible in a research laboratory facility. Temperatures may stray, for example, 50° F. of the target. Thus, having a wider window for processing conditions adds to the practical value of the process.

This invention is further described in, but not limited by, the examples given below. In all the examples the billets are prepared from dispersion strengthened alloy powder comprising aluminum, magnesium, lithium, silicon, carbon and oxygen, prepared by a mechanical alloying technique.

EXAMPLE 1

Powder for Al-Mg-Li-Si billets are prepared having the nominal magnesium, lithium, carbon, oxygen and silicon contents given in TABLE I. by mechanical alloying in a 100 S attritor.

TABLE I

| Alloy Type | Composition in Wt. % | | | | |
|---|---|---|---|---|---|
| | Mg | Li | Si | C | O |
| 1 | 4 | 1.5 | .5 | 1.2 | <1 |
| 2 | 4 | 1.5 | 1.0 | 1.2 | <1 |
| 3 | 2 | 1.5 | .5 | 1.2 | <1 |
| 4 | 2 | 1.5 | 1.0 | 1.2 | <1 |
| 5 | 2 | 2 | .5 | 1.2 | <1 |
| 6 | 2 | 2 | 1.0 | 1.2 | <1 |

The powders are vacuum hot pressed (VHP) at 520° C. (970° F.) for 16 hours at 5 ksi applied pressure from 27.9 cm (11 in.) diameter degassed to compaction billets. The compaction billets are extruded essentially as follows: A 5.08 cm (2 in.) 45° chamfer is machined onto the nose of each billet, and the billets are extruded at temperatures of about 260° C. (500° F.) at ram speeds of 25.4 cm (10 in.)/min. All billets are sandblasted and coated with Fel-Pro C-300 (a molybdenum disulfide air drying product of Fel-Pro Inc.) prior to heat-up for extrusion, and the extrusion liner coated with resin and swathed with the lubricant LUBE-A-TUBE hot extrusion 230A (a graphite in heavy oil product of G. Whitfield Richards Co.).

The extruded billets are forged at nominal temperature of 260° C. (500° F.) and 370° C. (700° F.) to form "Hook"-type forgings in a three step procedure: a 1st blocker die for high deformation, a 2nd blocker die to raise the ribs of the forging and a finish die to achieve final tolerances in the part.

EXAMPLE 2

Forged samples prepared as described in Example 1 using a nominal forging temperature of 370° C. (700° F.) are treated for age hardening as follows: Following a solution treatment at 525° C. (975° F.) for 2 hours and water quenching, samples are subjected to temperatures of approx. 105° C. (225° F.), 135° C. (275° F.) and 175° C. (350° F.) and hardness is determined over a period of time ranging from 0 to about 30 hours. The tests show that in the four alloy compositions of the type 1, 2, 3 and 4, which would not be age hardenable without the addition of silicon, there is no significant age hardening which occurs on the addition of silicon. The data on the alloys containing 2% lithium show particularly surprising results. It appears that age hardening expected from the presence of 2% lithium is not occurring.

EXAMPLE 3

Samples of forged alloys prepared as described in Example 1, using a nominal forging temperature of 370° C. (700° F.) are subjected to various heat treatments and tested for mechanical properties. Compositions, test conditions and results are tabulated in TABLES II, III and IV. In the Tables YS=0.2% offset yield strength, UTS=ultimate tensile strength, El=elongation and RA=reduction of area. Additional data show a comparison with alloys containing no silicon.

TABLE II

TENSILE PROPERTIES OF BASE Al—4Mg—1.5Li—1.2C

| Si Wt. % | Heat Treatment | Spec. Location | YS MPa | YS ksi | UTS MPa | UTS ksi | El % | RA % |
|---|---|---|---|---|---|---|---|---|
| 0.5 | B | 06 | 486 | 70.6 | 527 | 76.5 | 5 | 10 |
| 0.5 | C | 05 | 483 | 70.1 | 524 | 76.1 | 5 | 7 |
| 0.5 | D | 12 | 466 | 67.6 | 520 | 75.5 | 6 | 10 |
| 0.5 | E | 11 | 480 | 69.7 | 535 | 77.7 | 5 | 6 |
| 0.5 | F | 07 | 471 | 68.3 | 522 | 75.8 | 5 | 8 |
| 1.0 | B | 06 | | — | 517 | 75.0 | 3 | 6 |
| 1.0 | C | 05 | 497 | 72.1 | 531 | 77.1 | 4 | 6 |
| 1.0 | D | 12 | 466 | 67.6 | 513 | 74.5 | 3 | 7 |
| 1.0 | E | 11 | 485 | 70.4 | 519 | 75.3 | 4 | 5 |
| 1.0 | F | 07 | 466 | 67.6 | 520 | 75.5 | 3 | 6 |

TABLE III

TENSILE PROPERTIES OF BASE Al—2Mg—1.5Li—1.2C

| Si Wt. % | Heat Treatment | Spec. Location | YS MPa | YS ksi | UTS MPa | UTS ksi | El % | RA % |
|---|---|---|---|---|---|---|---|---|
| 0.5 | B | 06 | 440 | 63.8 | 488 | 70.8 | 5 | 11 |
| 0.5 | C | 05 | 440 | 63.9 | 503 | 73.0 | 5 | 9 |
| 0.5 | E | 11 | 457 | 66.3 | 498 | 72.3 | 5 | 8 |
| 1.0 | B | 06 | 471 | 68.3 | 512 | 74.3 | 4 | 5 |
| 1.0 | C | 05 | 478 | 69.4 | 513 | 74.4 | 3 | 4 |
| 1.0 | E | 11 | 483 | 70.1 | 511 | 74.1 | 2 | 7 |

TABLE IV

TENSILE PROPERTIES OF BASE Al—2Mg—2Li—1.2C

| Si Wt. % | Heat Treatment | Spec. Location | YS MPa | YS ksi | UTS MPa | UTS ksi | El % | RA % |
|---|---|---|---|---|---|---|---|---|
| 0.5 | B | 06 | 542 | 78.6 | 599 | 87.0 | 1 | 3 |
| 0.5 | C | 05 | 548 | 79.5 | 596 | 86.5 | 2 | 6 |
| 0.5 | D | 12 | 548 | 79.5 | 602 | 87.4 | 1 | 4 |
| 0.5 | E | 11 | 597 | 86.7 | 641 | 93.1 | 1 | 3 |
| 0.5 | F | 07 | 594 | 86.2 | 643 | 93.3 | 1 | 1 |
| 1.0 | B | 06 | 473 | 68.6 | 520 | 75.5 | 3 | 6 |
| 1.0 | C | 05 | 486 | 70.6 | 527 | 76.5 | 4 | 6 |
| 1.0 | D | 12 | 473 | 68.6 | 534 | 77.5 | 3 | 6 |

TABLE IV-continued

TENSILE PROPERTIES OF BASE Al—2Mg—2Li—1.2C

| Si Wt. % | Heat Treatment | Spec. Location | YS MPa | YS ksi | UTS MPa | UTS ksi | El % | RA % |
|---|---|---|---|---|---|---|---|---|
| 1.0 | E | 11 | 506 | 73.4 | 562 | 81.6 | 3 | 6 |
| 1.0 | F | 07 | 487 | 70.7 | 557 | 80.8 | 4 | 5 |
| 0 | A* | 10, 11 | 371 | 53.8 | 468 | 68.0 | 3 | — |
| 0 | G* | 08, 09 | 539 | 81.2 | 598 | 86.8 | 5 | — |
| 0 | H* | 38A | 495 | 71.9 | 545 | 79.1 | 5 | 2 |
| 0 | I* | 38B | 560 | 81.3 | 581 | 84.3 | 1 | 2 |

*Forged at 260° C. (500° F.)

The heat treatments in TABLES II, III and IV are as follows:

A=As-Forged
B=850° F./3 hr/AC
C=975° F./2 hr/WQ
D=975° F./2 hr/WQ+8 hr/275° F.
E=975° F./2 hr/WQ+16 hr/275° F.
F=975° F./2 hr/WQ+24 hr/275° F.
G=925° F./1 hr/WQ+10 hr/255° F./AC
H=925° F./2 hr/HWQ+6 hr/255° F.
I=925° F./2 hr/HWQ+24 hr/255° F.

The data in TABLES II and III show that in an aluminum-base alloy containing 2 to 4% magnesium and 1.5% lithium, the silicon levels of 0.5 and 1% have little effect on the alloy because the base composition is not age hardenable. The data in TABLE IV show that in alloys containing 2% lithium, age hardening occurs when the silicon level is 0.5% but little, if any, occurs at 1% silicon. Data in TABLE IV previously obtained on samples of similar composition with no added silicon and prepared under somewhat different conditions show that without silicon the alloy is age hardenable. A comparison of data in TABLE IV for sample containing 0.5% with 1% silicon shows that the addition of silicon restores ductility in the alloy.

EXAMPLE 4

Samples of the forged alloys, prepared by forging at 370° C. (700° F.) are annealed at 455° C. (850° F.) for 3 hours and air cooled. Densities of the samples are given in TABLE V.

TABLE V

| Alloy Type | Density (gm/cc) |
|---|---|
| 1 | 2.57 |
| 2 | 2.57 |
| 3 | 2.59 |
| 4 | 2.60 |
| 5 | 2.56 |
| 6 | 2.56 |

Silicon has substantially no affect on the densities of the alloys produced. Addition of magnesium and lithium have a greater affect on density. Addition of about 2% magnesium or 0.5% lithium has the effect of reducing the density of the alloy by about 0.02–0.03 gm/cc.

EXAMPLE 5

This example illustrates Al-Li-Si alloy systems containing additional elements other than magnesium. Typically such aluminum-base alloys contain about 0.5% to about 4% lithium, e.g., about 1% to 3%; about 0.3% to about 4% silicon, e.g., about 1% to 3%; 0 up to about 6% cobalt, e.g., about 2% to 4%; 0% up to about 6% copper, e.g., about 2% to 4%; 0% up to about 7% zinc, e.g., about 4% to 6%; 0% up to about 2% manganese, e.g., about 0.5 % to 1.5%; 0% up to about 6% nickel, e.g., about 2% to 4%; 0% up to about 8% iron, e.g., about 4% to 6%; 0% up to about 6% chromium, e.g., about 3% to 5%; 0% up to about 6% titanium, e.g., about 3% to 5%; 0% up to about 6% niobium, e.g., about 3% to 5%; 0% up to about 6% zirconium, e.g., about 3% to 5%; 0% up to about 6% vanadium, e.g. about 3% to 5%; 0% up to about 5% rare earth metals, e.g. about 2% to about 4%.

Alloys of this type are illustrated in TABLE VI.

TABLE VI

| Al | Cu | Mn | Mg | Cr | Zn | Ti | Li | Si | Zr | Co | Ni | Fe | Ce | V | Nb |
|---|---|---|---|---|---|---|---|---|---|---|---|---|---|---|---|
| Bal. | 4.4 | .8 | .5 | — | — | .15 | 2.0 | 1.3 | .1 | — | — | — | — | — | — |
| Bal. | 4.4 | .8 | .5 | — | — | .15 | 2.5 | 1.7 | .1 | — | — | — | — | — | — |
| Bal. | 4.4 | .8 | .5 | — | — | .15 | 3.0 | 2.0 | .1 | — | — | — | — | — | — |
| Bal. | 4.4 | .8 | .5 | — | — | .15 | 3.5 | 2.3 | .1 | — | — | — | — | — | — |
| Bal. | 4.4 | .8 | .5 | — | — | .15 | 4.0 | 2.7 | .1 | — | — | — | — | — | — |
| Bal. | 1.6 | — | 2.5 | .23 | 5.6 | .15 | 2.0 | 1.3 | .1 | — | — | — | — | — | — |
| Bal. | 1.6 | — | 2.5 | .23 | 5.6 | .15 | 2.5 | 1.7 | .1 | — | — | — | — | — | — |
| Bal. | 1.6 | — | 2.5 | .23 | 5.6 | .15 | 3.0 | 2.0 | .1 | — | — | — | — | — | — |
| Bal. | 1.6 | — | 2.5 | .23 | 5.6 | .15 | 3.5 | 2.3 | .1 | — | — | — | — | — | — |
| Bal. | 1.6 | — | 2.5 | .23 | 5.6 | .15 | 4.0 | 2.7 | .1 | — | — | — | — | — | — |
| Bal. | 2.6 | .25 | .45 | — | — | — | 2.0 | 1.3 | .1 | — | — | — | — | — | — |
| Bal. | 2.6 | .25 | .45 | — | — | — | 2.5 | 1.7 | .1 | — | — | — | — | — | — |
| Bal. | 2.6 | .25 | .45 | — | — | — | 3.0 | 2.0 | .1 | — | — | — | — | — | — |
| Bal. | 2.6 | .25 | .45 | — | — | — | 3.5 | 2.3 | .1 | — | — | — | — | — | — |
| Bal. | 2.6 | .25 | .45 | — | — | — | 4.0 | 2.7 | .1 | — | — | — | — | — | — |
| Bal. | — | .45 | 1.4 | .13 | 4.5 | .05 | 2.0 | 1.3 | .1 | — | — | — | — | — | — |
| Bal. | — | .45 | 1.4 | .13 | 4.5 | .05 | 2.5 | 1.7 | .1 | — | — | — | — | — | — |
| Bal. | — | .45 | 1.4 | .13 | 4.5 | .05 | 3.0 | 2.0 | .1 | — | — | — | — | — | — |
| Bal. | — | .45 | 1.4 | .13 | 4.5 | .05 | 3.5 | 2.3 | .1 | — | — | — | — | — | — |
| Bal. | — | .45 | 1.4 | .13 | 4.5 | .05 | 4.0 | 2.7 | .1 | — | — | — | — | — | — |
| Bal. | — | — | — | — | — | — | 3 | 2 | .1 | — | — | 4 | 2 | — | — |
| Bal. | — | — | — | — | — | — | 3.5 | 2.3 | .1 | — | — | 4 | 2 | — | — |
| Bal. | — | — | — | — | — | — | 4.0 | 2.7 | .1 | — | — | 4 | 2 | — | — |
| Bal. | — | — | — | — | — | — | 2.0 | 1.3 | .1 | — | — | 8 | 4 | — | — |
| Bal. | — | — | — | — | — | — | 2.5 | 1.7 | .1 | — | — | 8 | 4 | — | — |
| Bal. | — | — | — | — | — | — | 3.0 | 2.0 | .1 | — | — | 8 | 4 | — | — |
| Bal. | — | — | — | — | — | — | 3.0 | 2.0 | .1 | 2 | — | — | — | — | — |
| Bal. | — | — | — | — | — | — | 3.5 | 2.3 | .1 | 2 | — | — | — | — | — |
| Bal. | — | — | — | — | — | — | 4.0 | 2.7 | .1 | 2 | — | — | — | — | — |
| Bal. | — | — | — | — | — | — | 2.0 | 1.3 | .1 | 4 | — | — | — | — | — |

TABLE VI-continued

| Al | Cu | Mn | Mg | Cr | Zn | Ti | Li | Si | Zr | Co | Ni | Fe | Ce | V | Nb |
|---|---|---|---|---|---|---|---|---|---|---|---|---|---|---|---|
| Bal. | — | — | — | — | — | — | 2.5 | 1.7 | .1 | 4 | — | — | — | — | — |
| Bal. | — | — | — | — | — | — | 3.0 | 2.0 | .1 | 4 | — | — | — | — | — |
| Bal. | — | — | — | — | — | — | 3.0 | 2.0 | .1 | — | 2 | 4 | — | — | — |
| Bal. | — | — | — | — | — | — | 3.5 | 2.3 | .1 | — | 2 | 4 | — | — | — |
| Bal. | — | — | — | — | — | — | 4.0 | 2.7 | .1 | — | 2 | 4 | — | — | — |
| Bal. | — | — | — | — | — | — | 2.0 | 1.3 | .1 | — | 3 | 6 | — | — | — |
| Bal. | — | — | — | — | — | — | 2.5 | 1.7 | .1 | — | 3 | 6 | — | — | — |
| Bal. | — | — | — | — | — | — | 3.0 | 2.0 | .1 | — | 3 | 6 | — | — | — |
| Bal. | — | — | — | — | — | — | 3.0 | 2.0 | .1 | — | — | — | — | 1.0 | — |
| Bal. | — | — | — | — | — | — | 3.5 | 2.3 | .1 | — | — | — | — | 1.0 | — |
| Bal. | — | — | — | — | — | — | 4.0 | 2.7 | — | — | — | — | — | 1.0 | — |
| Bal. | — | — | — | — | — | — | 2.0 | 1.3 | — | — | — | — | — | 2.5 | — |
| Bal. | — | — | — | — | — | — | 2.5 | 1.7 | — | — | — | — | — | 2.5 | — |
| Bal. | — | — | — | — | — | — | 3.0 | 2.0 | — | — | — | — | — | 2.5 | — |
| Bal. | — | — | — | — | — | 2 | 4.0 | 2.7 | — | — | — | — | — | — | — |
| Bal. | — | — | — | — | — | 4 | 3.0 | 2.0 | — | — | — | — | — | — | — |
| Bal. | — | — | — | — | — | — | 4.0 | 2.7 | — | — | — | — | — | — | 2 |
| Bal. | — | — | — | — | — | — | 3.0 | 2.0 | — | — | — | — | — | — | 4 |
| Bal. | — | — | — | 2 | — | — | 4.0 | 2.7 | — | — | — | — | — | — | — |
| Bal. | — | — | — | 4 | — | — | 3.0 | 2.0 | — | — | — | — | — | — | — |
| Bal. | — | — | — | — | — | — | 4.0 | 2.7 | 2 | — | — | — | — | — | — |
| Bal. | — | — | — | — | — | — | 4.0 | 2.7 | — | — | 4 | — | — | — | — |
| Bal. | — | — | — | — | — | — | 3.0 | 2.0 | — | — | 6 | — | — | — | — |

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. A dispersion strengthened alloy comprising aluminum, lithium and silicon, said alloy consisting essentially, by weight, of lithium in an amount which is above the solubility limit of lithium in said alloy at room temperature up to the maximum solubility of lithium in said alloy at elevated temperature, silicon in an amount from a small but effective amount for improved ductility or strength up to about 4%, carbon in a small but effective amount for increased strength up to about 5%, oxygen in a small but effective amount for increased strength or stability up to about 1%, magnesium in an amount ranging from 0 up to about 7%, and the balance essentially aluminum.

2. A dispersion strengthened alloy according to claim 1, wherein, by weight, the lithium content is about 1.3 up to about 4%.

3. A dispersion strengthened aluminum alloy according to claim 10, wherein, by weight, the silicon content is about 0.5% up to about 1.5%.

4. A dispersion strengthened aluminum alloy according to claim 2, wherein, by weight, the lithium content is about 1.3% up to about 3%, the silicon content is about 0.5% up to about 2%, the magnesium content is about 1% up to about 4.5%, the carbon content is about 0.5% up to about 2%, and the oxygen content is less than 1%.

5. A dispersion strengthened alloy according to claim 1, wherein magnesium is present.

6. A dispersion strengthened alloy according to claim 5, wherein, by weight, the lithium content is about 1.3% up to about 2%, the magnesium content is about 2% up to about 4.5%, the silicon content is about 0.5% up to about 1%.

7. A dispersion strengthened aluminum alloy according to claim 1, wherein, by weight, the lithium content is above 1.5% and the silicon content is about 0.5% up to about 2%.

8. A dispersion strengthened alloy according to claim 7, wherein, by weight, the magnesium content is above about 4%.

9. A dispersion strengthened alloy comprising aluminum, lithium and silicon, said alloy consisting essentially of, by weight, of an amount which is above the solubility limit of lithium in said alloy at room temperature up to the maximum solubility of lithium in said alloy at elevated temperature, silicon in an amount from a small but effective amount for improved ductility or strength up to about 4%, and said alloy, carbon in a small but effective amount for increased strength up to about 5%, oxygen in a small but effective amount for increased strength or stability up to about 1%, magnesium in an amount ranging from 0 up to about 7%, cobalt in an amount ranging from 0 up to about 6% copper in an amount ranging from 0 up to about 6%, zinc in an amount ranging from 0 up to about 7%, manganese in an amount ranging from 0 up to about 2%, chromium in an amount ranging from 0 up to about 6%, nickel in an amount ranging from 0 up to about 6%, iron in an amount ranging from 0 up to about 8%, titanium in an amount ranging from 0 up to about 6%, niobium in an amount ranging from 0 up to about 6%, zirconium in an amount ranging from 0 up to about 6%, vanadium in an amount ranging from 0 up to about 6%, rare earth metals in an amount ranging from 0 up to about 5%.

10. A process for (i) lowering the density of powder metallurgical aluminum-base, lithium-containing alloys, and (2) concommitantly achieving good ductility and thus minimizing the embrittling effect of the lithium which comprises (a) the step of incorporating silicon in such alloys in an amount sufficient and up to 4% such that lithium is present in a percentage above its solubility limit at room temperature and up to its solubility limit at elevated temperature, and (b) thereafter forming the alloy as a dispersion strengthened powder product.

11. A process according to claim 10, wherein the dispersion strengthened powder is prepared by a method comprising mechanical alloying, atomization or a combination thereof.

12. A dispersion strengthened alloy composition made by the process of claim 11.

13. A mechanically alloyed composition consisting essentially of aluminum, lithium, magnesium and silicon made by the process of claim 11.

14. A process according to claim 10, wherein the alloy composition comprises in addition to aluminum, lithium and silicon, at least one element from the group magnesium, cobalt, copper, nickel, iron, chromium, zinc, manganese, titanium, niobium, zirconium, vanadium and rare earth elements.

15. A process according to claim 10, wherein the aluminum-base composition consists essentially of aluminum, lithium and silicon.

16. A process according to claim 10, wherein dispersion strengthened powder is prepared by mechanical alloying.

17. A dispersion strengthened alloy composition made by the process of claim 10.

* * * * *